US010593237B2

(12) United States Patent
Mayer et al.

(10) Patent No.: US 10,593,237 B2
(45) Date of Patent: Mar. 17, 2020

(54) INTERACTIVE DISPLAY MODULE

(71) Applicant: American Greetings Corporation, Cleveland, OH (US)

(72) Inventors: David Mayer, Bay Village, OH (US); Lynne Shlonsky, Shaker Heights, OH (US); Anthony Santarelli, North Olmsted, OH (US); Jeff Myler, Bedford Heights, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 16/297,856

(22) Filed: Mar. 11, 2019

(65) Prior Publication Data

US 2019/0281999 A1 Sep. 19, 2019

Related U.S. Application Data

(60) Provisional application No. 62/642,302, filed on Mar. 13, 2018.

(51) Int. Cl.

| | |
|---|---|
| ***G09F 11/23*** | (2006.01) |
| ***G09F 3/20*** | (2006.01) |
| *A47F 5/00* | (2006.01) |
| *G09F 11/02* | (2006.01) |
| *A47F 7/14* | (2006.01) |

(52) U.S. Cl.

CPC ..... *G09F 11/23* (2013.01); *G09F 3/20* (2013.01); *A47F 5/0037* (2013.01); *A47F 5/0087* (2013.01); *A47F 7/145* (2013.01); *G09F 11/02* (2013.01)

(58) Field of Classification Search

USPC ..... 40/493, 503, 506, 484

See application file for complete search history.

(56) References Cited

U.S. PATENT DOCUMENTS

| | | | | |
|---|---|---|---|---|
| 3,159,937 | A * | 12/1964 | Barnes | G09F 3/202 40/446 |
| 3,387,394 | A * | 6/1968 | Werner | G09F 11/025 40/505 |
| 3,410,011 | A | 11/1968 | Bowman | |
| 3,706,148 | A | 12/1972 | Johnston | |
| 4,381,616 | A | 5/1983 | Saxer | |
| 4,432,151 | A * | 2/1984 | Morris | G09F 23/06 211/131.1 |
| 4,528,763 | A | 7/1985 | Ahlgren | |

(Continued)

FOREIGN PATENT DOCUMENTS

| | | |
|---|---|---|
| AU | 2010200889 | 4/2010 |
| EP | 0938070 | 8/1999 |

*Primary Examiner* — Kristina N Junge

(74) *Attorney, Agent, or Firm* — Christine Flanagan

(57) ABSTRACT

An interactive display module operative to be inserted over an existing tiered greeting card display fixture. The interactive display may contain one or more spinners which are able to spin about a horizontal axis. Each spinner contains many sides or facets, each side or facet containing a removable caption strip thereon containing various words, phrases, graphics or other printed matter. The use of two or more spinners allow for the random creation or phrases, graphics, etc. that are intended to provide the consumer with a fun way to interact with the greeting card fixture.

18 Claims, 7 Drawing Sheets

(56) References Cited

U.S. PATENT DOCUMENTS

| | | | | | |
|---|---|---|---|---|---|
| 4,638,580 | A * | 1/1987 | Giannetti | G09F 11/025 | 40/503 |
| 4,777,744 | A | 10/1988 | Barnett | | |
| 5,158,310 | A * | 10/1992 | Tannehill | B62B 3/1408 | 186/62 |
| 5,185,948 | A * | 2/1993 | Markson | G09F 3/204 | 248/296.1 |
| 5,416,996 | A * | 5/1995 | Clemens | G09F 11/025 | 40/502 |
| 6,256,912 | B1 * | 7/2001 | Gibson | G09F 3/20 | 40/493 |
| 6,434,868 | B1 | 8/2002 | Bergeron | | |
| 7,003,907 | B2 * | 2/2006 | Leung | G09F 11/025 | 40/424 |
| 7,823,307 | B2 | 11/2010 | Gibbs | | |
| 2012/0318759 | A1 * | 12/2012 | Buettner | A47F 7/145 | 211/55 |

* cited by examiner

INTERACTIVE DISPLAY MODULE

RELATED APPLICATIONS

This application is a non-provisional of and claims priority to U.S. Provisional Patent Application No. 62/642,302, filed on Mar. 13, 2018, a copy of which is incorporated herein by reference in its entirety.

FIELD OF THE INVENTION

The present invention is in the field of display racks or assemblies for displaying merchandise, such as greeting cards, in a retail environment.

SUMMARY OF THE INVENTION

An interactive display module operative to be inserted over a portion of an existing greeting card display fixture. The interactive display may have one or more interactive spinners thereon. Each of the one or more spinners contains a plurality of sides or facets, each of the plurality of sides or facets having a transparent channel contained thereon where caption strips may be inserted and removed. The caption strips may contain words, phrases, advertising, graphics or any other printed material. The one or more spinners are operative to spin about a horizontal axis. The user of two or more spinners on the interactive display module allows for the random generation of a combination of words, phrases or other printed matter. Such printed matter may be intended to be fun and silly to provide the consumer with a higher level of entertainment and activity while shopping in the greeting card aisle.

DETAILED DESCRIPTION OF PREFERRED AND ALTERNATE EMBODIMENTS

Figure 1:
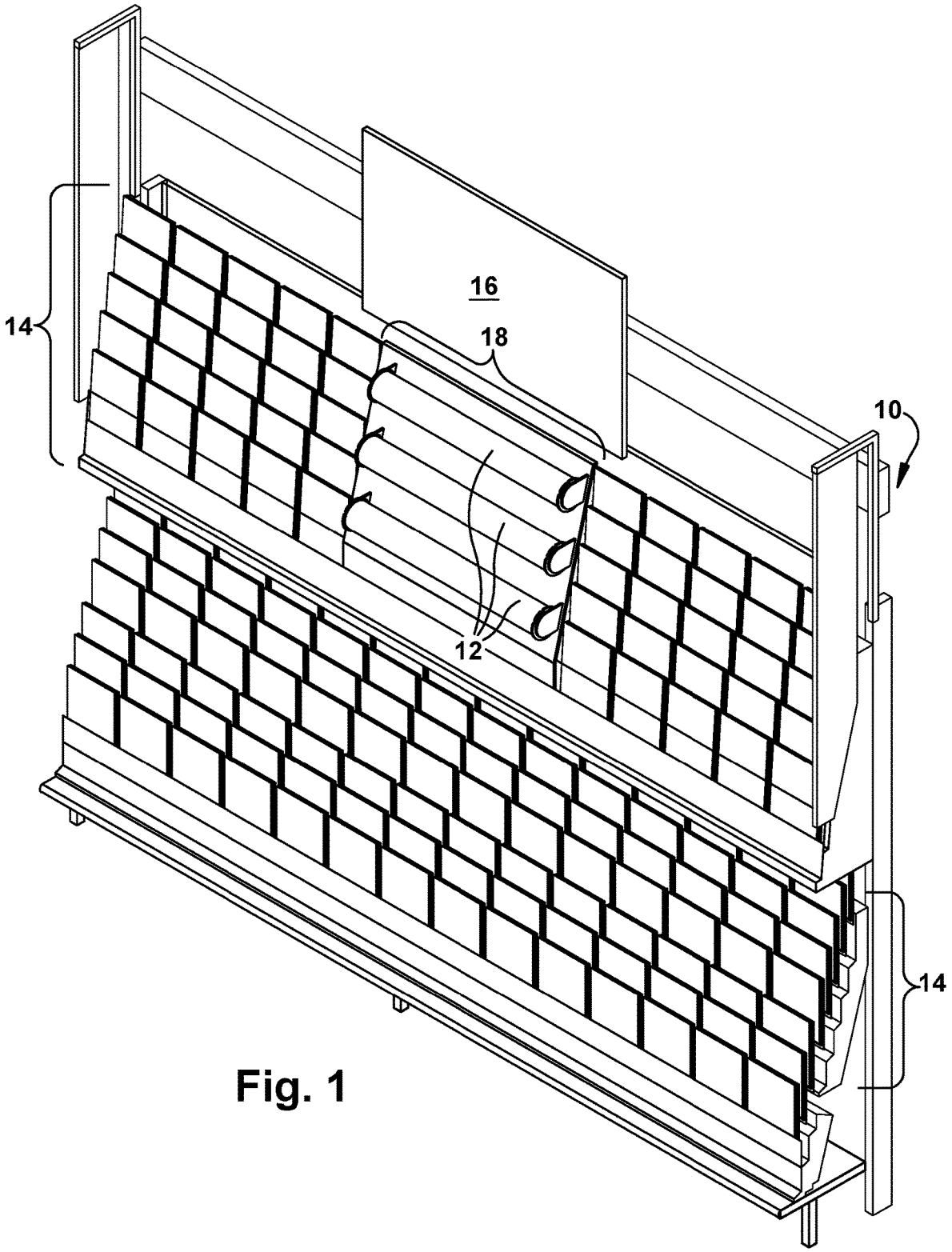
FIG. 1 is a perspective view of one embodiment of the fixture of the present invention.

The interactive display module of the present disclosure and related inventions is operative to be placed over an existing tiered greeting card display fixture. The module contains an interactive component allowing for interchangeable marketing materials and entertaining messaging.

A greeting card fixture 10, which may be an existing fixture or which may be manufactured for use with the one or more interactive spinners 12 may include, for example, a framing assembly and display rack. The framing assembly may contain a base and upright back support. The base may include a plurality of horizontal members (short and long) which combine to create a substantially rectangular shape.

The base provides a foundation for the remainder of the framing assembly and display rack. The base may rest on a retail floor or platform. In one embodiment, the long members of the base may have a length of approximately 48 inches and the short members may have a length of approximately 18 inches. At least the outermost vertical members of the base may contain a series of slots which are consistently spaced along the length of the member (slotted uprights). These slots may be used to facilitate engagement of card tiers or other display elements to the fixture. The upright back support of the framing assembly may include a plurality of horizontal and vertical members which extend upward from the base to create a substantially planar upright back support. In one embodiment, the vertical members of the upright back support have a length of approximately 59 inches. The display rack may include one or more card tiers 14 which are attached to the upright back support of the framing assembly. In one embodiment, each card tier 14 is vacuum formed. Each card tier 14 contains a plurality of tiers or steps which are arranged in a downward cascading manner wherein beginning with the uppermost row, each successive tier or step projects downward and outward from each preceding step, with each row being at a lower elevation and positioned slightly forward from the row directly above. Each horizontal step or section serves as the floor of a plurality of card pockets arranged along said section for supporting a plurality of greeting cards placed thereon. With the exception of the upper and lower most card tier, each vertical portion of the card tier serves as the back of a card tier and also the front of the tier directly below. A rear wall may serve as the back of the upper most card tier and a front wall may serve as the front of the lowermost tier. A plurality of divider clips may be inserted over each card row along the width of each row to divide the row into individual pockets into which groups of greeting cards may be inserted. In one embodiment, each card tier 14 may have a depth of, for example, 2 inches. The display assembly may also include a plurality of signage 16, such as, for example, caption strips and banners announcing greeting card brands, categories and sub-categories, dividers, and marketing materials. Additionally, the display assembly may also include one or more card highlighters which are placed over a portion of one or more card tiers, typically at eye level to attract the attention of consumers. Card highlighters may contain a small grouping of greeting cards which may be new, particularly trendy or relevant. The greeting card fixture 10 as described herein is an example of one type of fixture that may be used in combination with the interactive display module of the present disclosure and related inventions. Other tiered fixtures may also be used.

Figure 2:
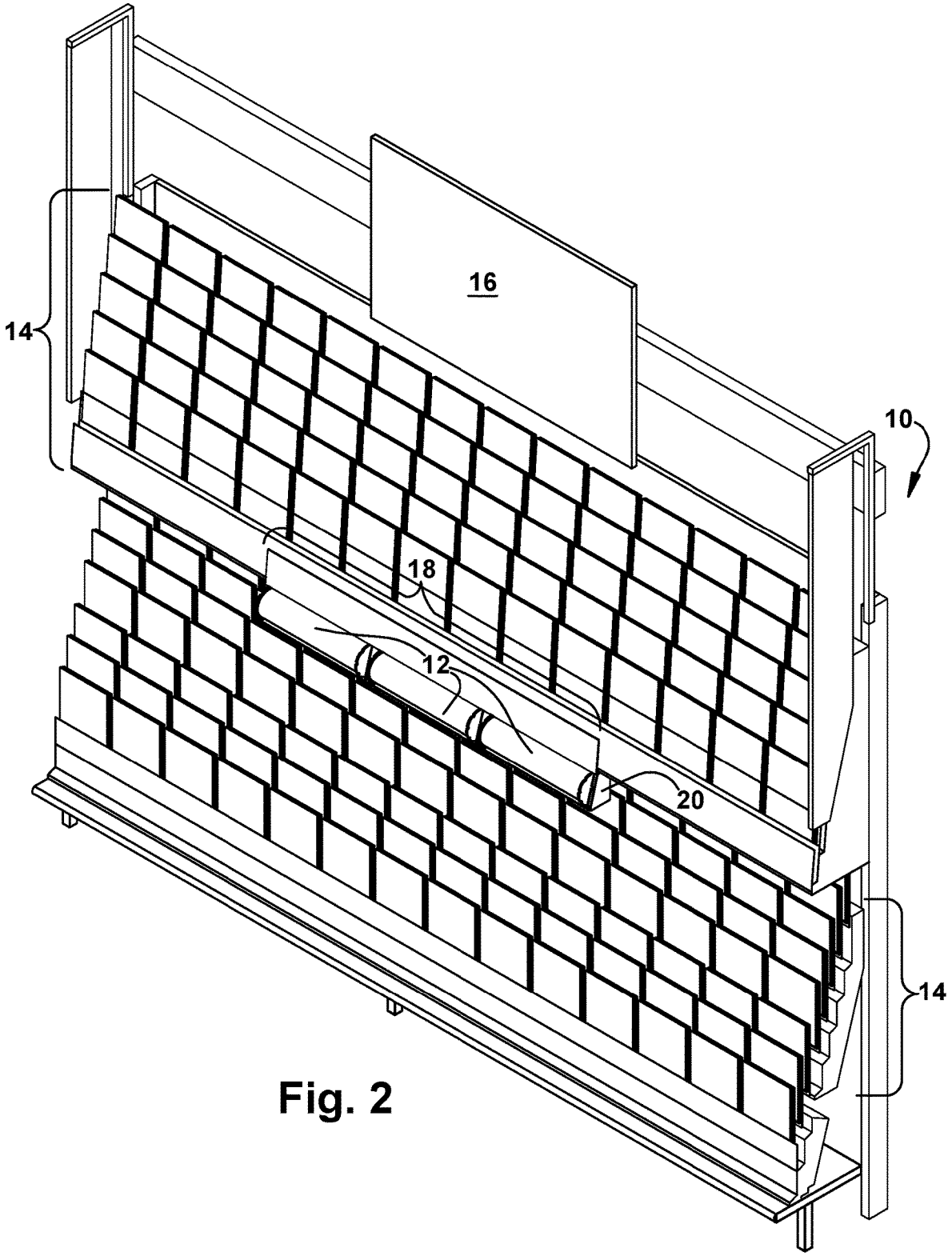
FIG. 2 is a perspective view of a second embodiment of the fixture of the present invention.
Figure 3:
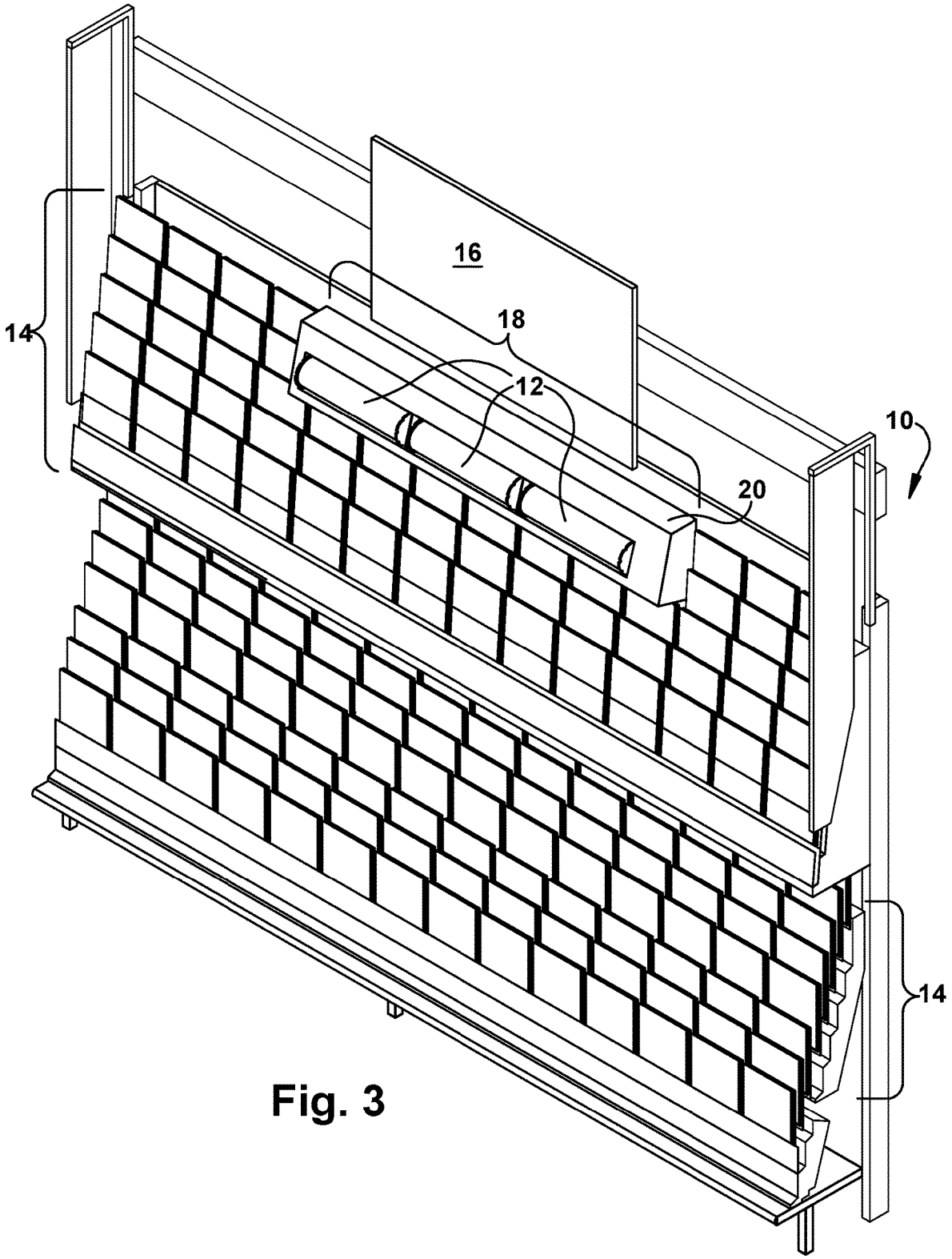
FIG. 3 is a perspective view of a third embodiment of the fixture of the present invention.
Figure 4:
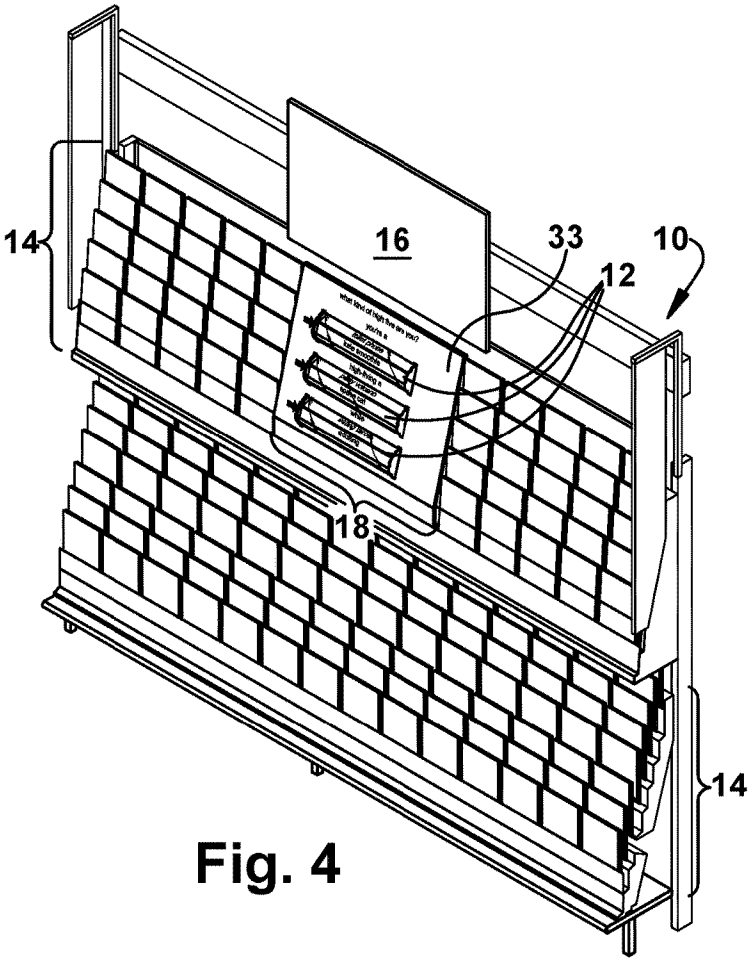
FIG. 4 is a perspective view of a fourth embodiment of the fixture of the present invention.
Figure 6:
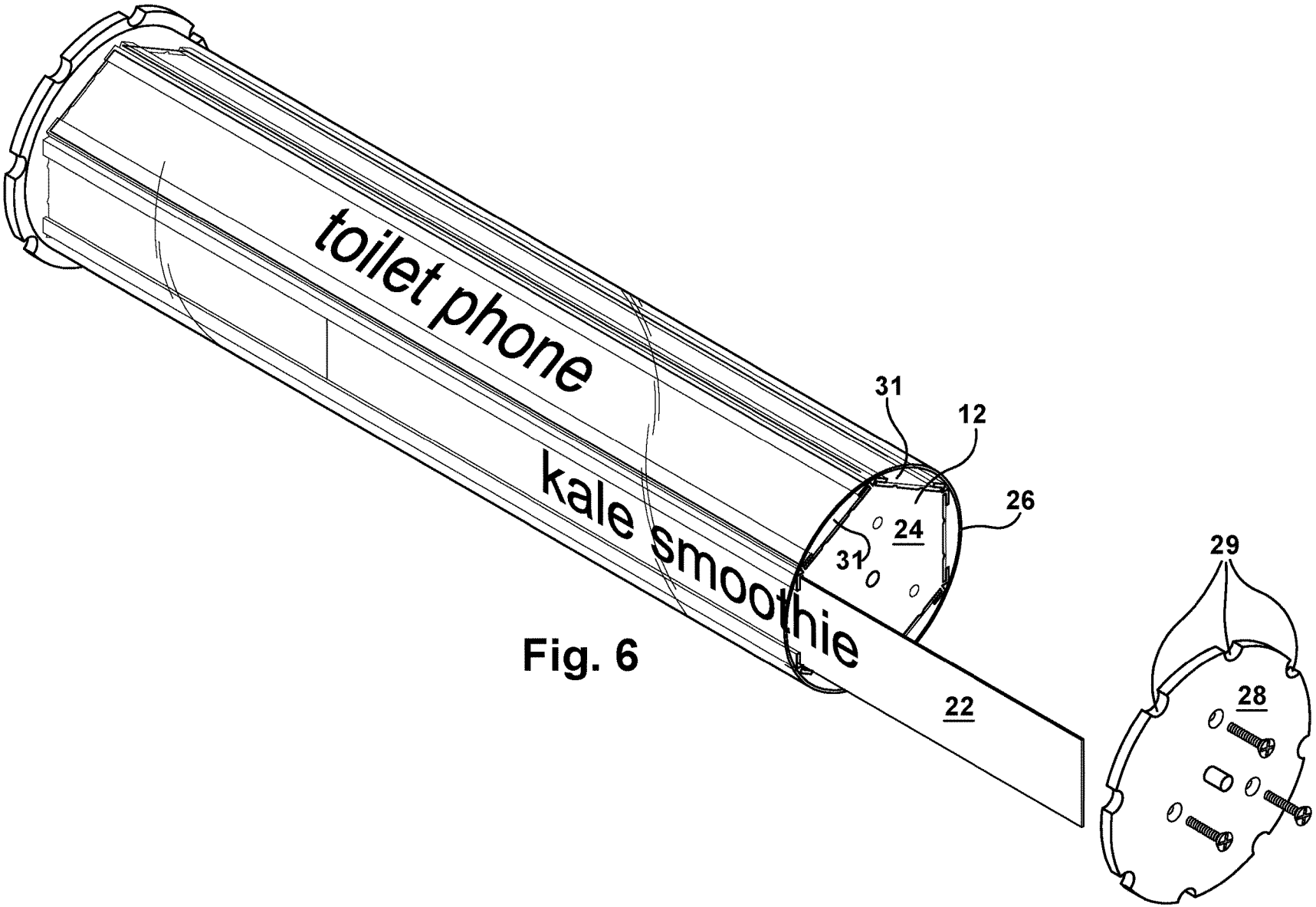
FIG. 6 is a perspective view of a representative spinner.
Figures 7, 8:
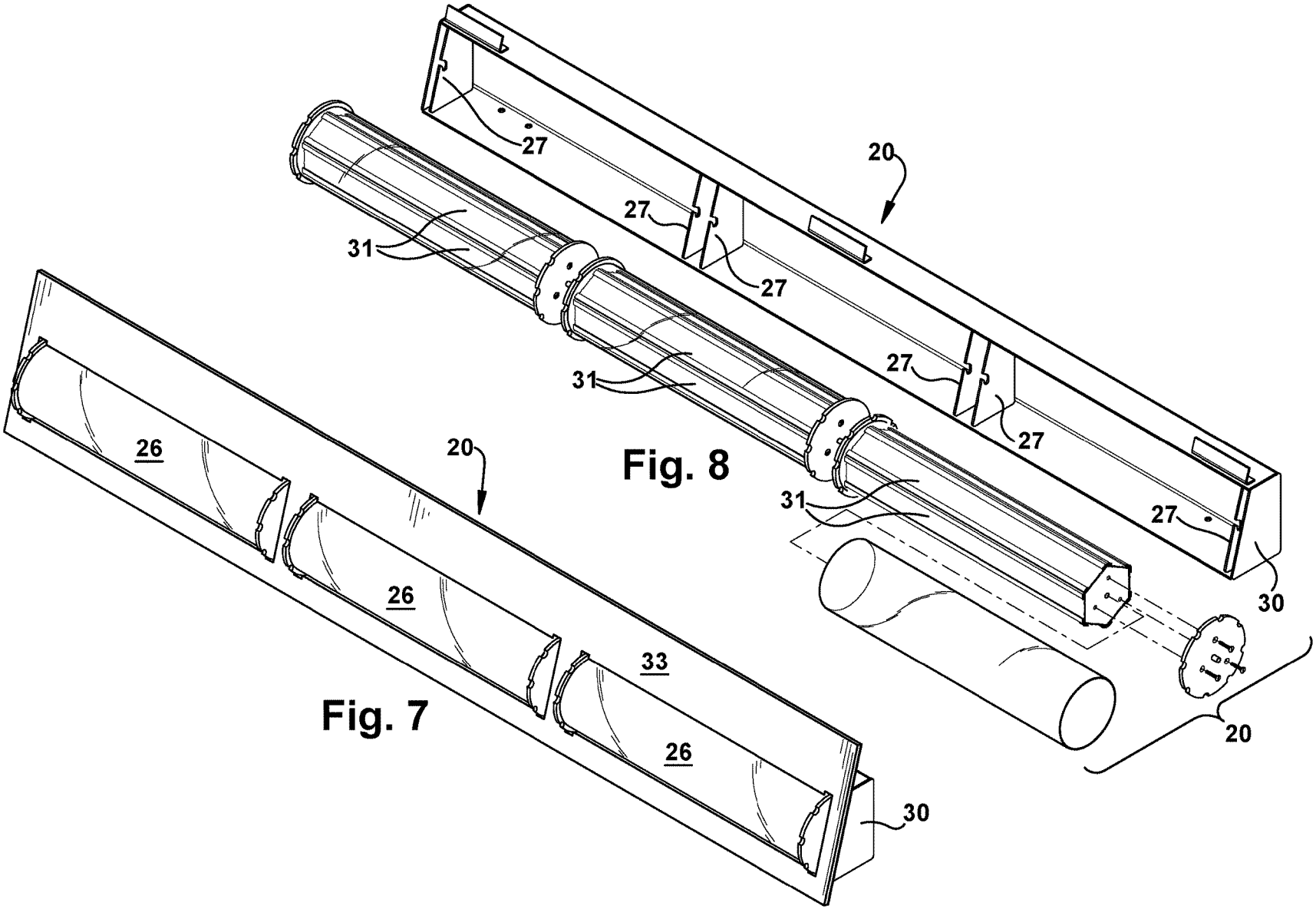
FIG. 7 is a perspective view of a spinner module.
FIG. 8 is an exploded view of a spinner module.

The interactive display module of the present disclosure and related inventions, in one embodiment, is an interactive display unit 18 containing one or more interactive spinner modules 20. The interactive display 18 may be placed atop or over existing greeting card tiers 14, similar to a greeting card highlighter, as described above. In one embodiment, each of the one or more spinners 12 is an elongate, multi-faceted element which can be attached to a spinner module 20 such that it is movable or able to spin or rotate. In one embodiment, the one or more spinners 12 contain six sides or facets, although spinners with any other number of sides or facets may be used. Each side or facet has a substantially planar surface onto which a clear or transparent channel 31 is affixed. A caption strip 22 may be inserted into each channel 31 on each side or facet of a spinner 12, as shown in FIG. 6. The caption strip 22 may contain a word or phrase, marketing slogan, picture, drawing or any other printed material. The distal ends of each spinner may contain a cap 24 thereon. Once the caption strip 22 is inserted into the channel on each side or facet of the spinner 12, the entire spinner 12 is inserted into a protective transparent cover or tube (referred to hereafter as "spinner cover") 26. Each distal end of the spinner cover 26 may contain a lid or cap 28 having one or more pre-set holes or apertures thereon. These lids or caps 28 may be circular and have a circumference which is larger than the circumference of the tube 26 thereby creating an excess portion of the lid or cap 28 to extend beyond the bounds of the spinner cover 26 openings at each distal end. The lid or cap 28 may additionally contain non-smooth edges having a plurality of notches 29 therein. This allows for consumers to grasp and spin the spinners 12 inside of the spinner covers 26. The pre-set holes or apertures on the spinner cover lid or cap 28 facilitate the attachment of the spinner 12 (within the tube 26) to a spinner module 20. A spinner module 20 includes a housing 30, an attachment mechanism 32 and one or more spinners 12 (inside spinner covers 26), as shown in FIGS. 7 and 8. For example, as shown in FIGS. 1 and 4, a spinner module 30 may contain three spinners 12 arranged in a vertical configuration. FIGS. 2 and 3 show an alternate embodiment having a spinner module 30 with three spinners 12 arranged in a horizontal configuration. Alternatively, a spinner module 20 may contain only a single spinner 12, two spinners 12, or greater than three spinners 12. The spinners 12 may be arranged horizontally, vertically or in any other spatial arrangement or physical orientation. The one or more spinners 12 (within spinner covers 26) are inserted into a spinner housing 30 which may be an open sided casing or cradle. A plurality of shelf brackets 27 are contained on an inside surface of the spinner housing 30. The number of shelf brackets 27 depends on the number of spinners 12. For example, if the housing 30 contains only a single spinner 12 then the housing 30 would contain two shelf brackets 27, each bracket 27 located at one distal end of the housing 30. If the housing 30 contains three spinners 12, then the housing 30 would contain six shelf brackets 27—one at each distal end and four strategically positioned along the length of the housing 30 to accommodate the width of each spinner 12, as shown in FIG. 8. The shelf brackets 27 engage with screws or other assembly hardware extending outward from the lid or cap 28 at each distal end of each spinner cover 26 (containing spinner 12). The spinner housing 30 is then attached to a tiered shelf (not shown) using one or more screws or other assembly hardware. The tiered shelf includes a horizontal tier with two mounting brackets, one mounting bracket located at each distal end of the horizontal tier. Each mounting bracket may contain one or more engagement tabs which engage with the slotted uprights on a greeting card fixture to connect the spinner module 20 to the fixture 10. A sign panel 33 may be placed over the front facing surface of the spinner housing 30. The entire spinner module 20 can then be attached to a greeting card fixture 10 by inserting the engagement tabs on the mounting bracket with the slotted uprights of the greeting card fixture 10. The spinner module 20 is inserted directly over and in front of existing greeting card tiers 14, as shown in FIGS. 1 through 4.

The caption strips 22 can be easily interchanged to create a new look. To change the caption strips 22, the spinner covers 26 must be removed from the spinner housing 30. The spinners 12 are then removed from the spinner covers 26 by removing at least one end cap 28. The existing caption strips 22 can be removed by sliding them out of the channel 31 attached to each side or facet of the spinner 12. A new caption strip 22 can then be inserted.

Figure 5:
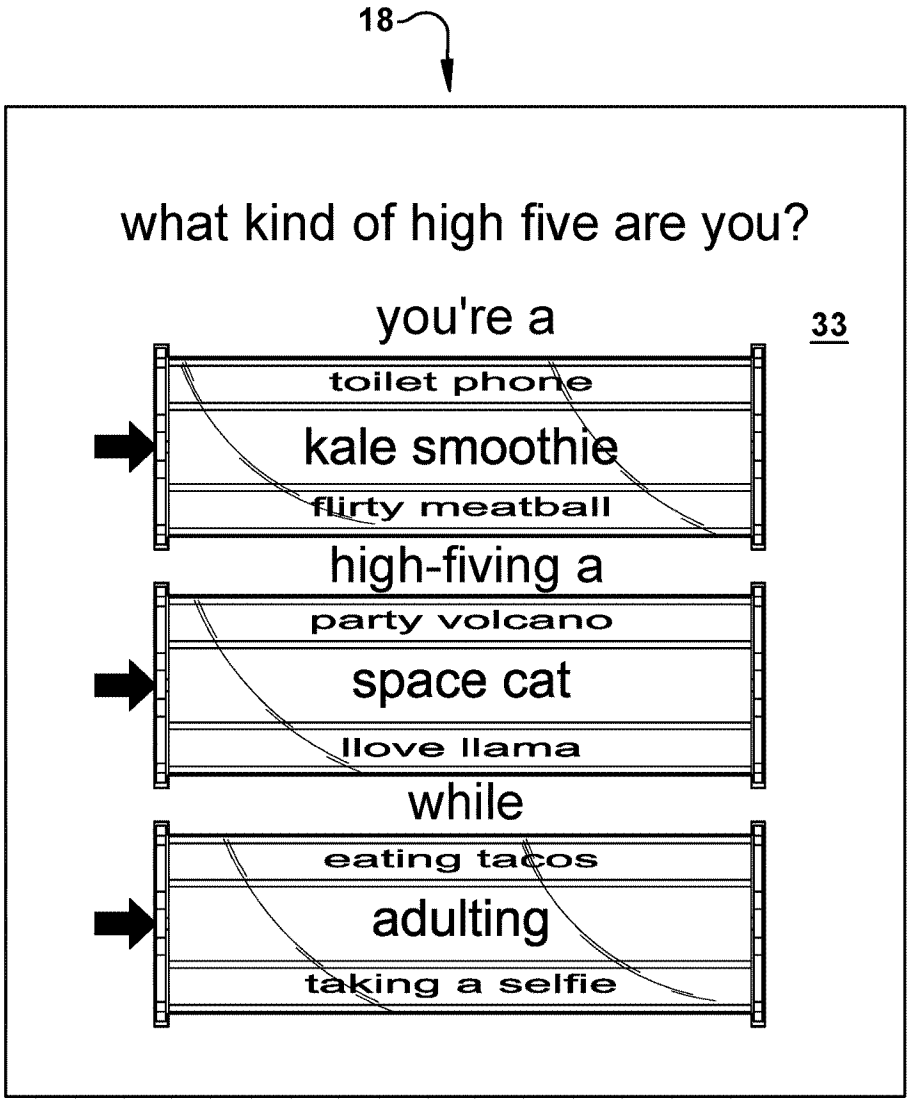
FIG. 5 is a representative interactive portion of the display of the present invention.
Figure 9:
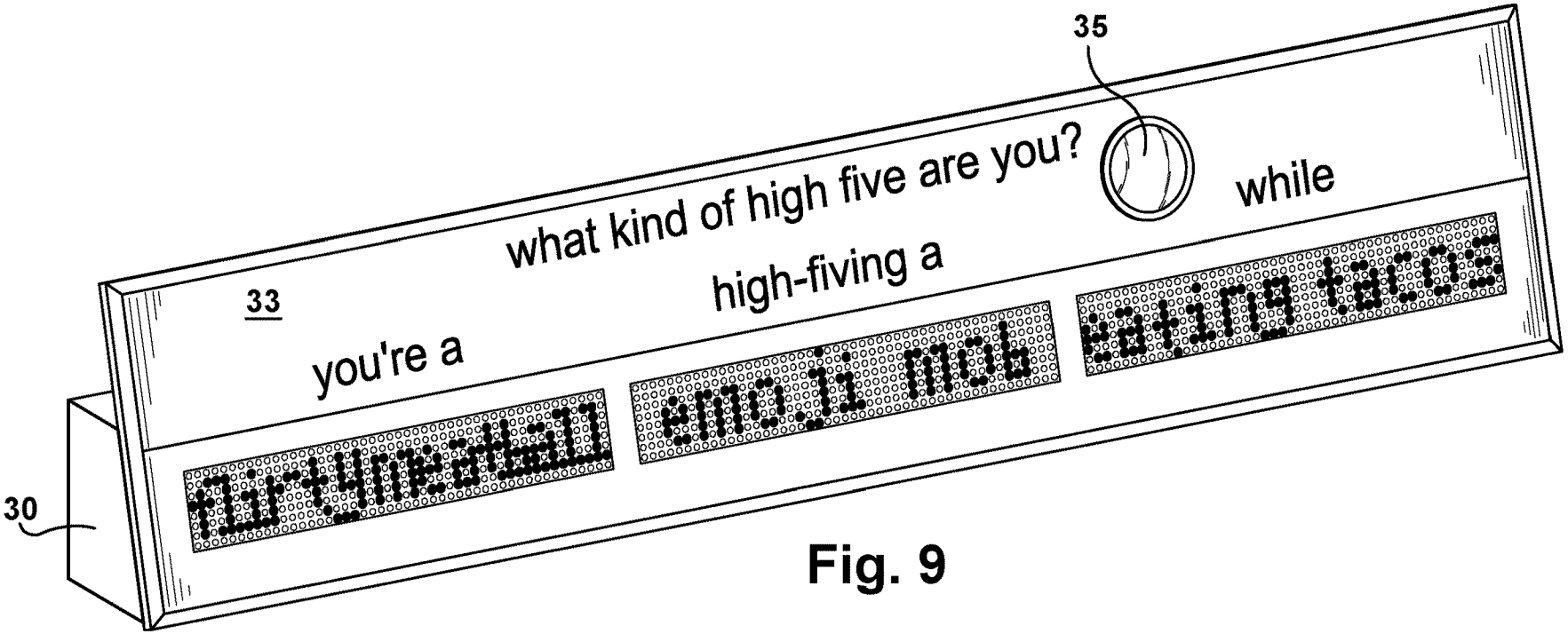
FIG. 9 is an alternative embodiment of the spinner module.

In use, the spinner module 20 will be placed over a section of a tiered greeting card fixture 10 by the method described above. Consumers can approach the fixture 10, read the sign panel 33 which may contain instructions or a suggestion to spin the one or more spinners 12. The spinners 12 can be spun by swiping the spinner cover 26 (with spinner 12 inside) with a quick up or down motion. The spinner 12 will spin and land on a particular front-facing side or facet. Each side or facet may contain a word, phrase, sentence or image. Other words or phrases, such as a question may be printed on the sign panel 33 above the spinners 12, as shown in FIG. 5. In an embodiment that contains three separate spinners 12, the consumer may read the question and the swipe or spin each of the three spinners 12 which will each reveal a word or phrase that answers the question printed thereabove. The words or phrases taken in combination may make up a silly phrase or sentence. While this interactive scheme is described herein as having words or phrases on each side or facet of each spinner 12 with a question posted nearby, other schemes can be used where each side or facet contains a picture or symbol, similar to a slot machine. In other embodiments, shown, for example, in FIG. 9, the spinners 12 may be electronic with an electronic display on each facet or side and spinning may be effected by pushing a button 35 or pulling a lever.

To increase the entertainment factor and the level of interactivity, in some embodiments, the fixture may contain a sound module which plays sound when each spinner 12 is swiped or spun. The sound may be a musical sound, a noise like the sound of a slot machine or a clicking noise, spoken word, a song, or any other recordable material. The sound module may be contained within the spinner module 20 and may include but is not limited to: a printed circuit board, a power source, a memory device for storing at least one audio file, a speaker, a switch, and related wires and circuitry. Alternatively, the spinners 12 themselves may make a mechanical clicking noise when swiped or spun.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. An interactive display fixture comprising:

a framing assembly including a base;

a display assembly attached to the framing assembly, the display assembly comprising one or more tiered rows;

an interactive module removably attached to the display assembly, the interactive module comprising one or more spinners, each of the one or more spinners having a plurality of sides or facets and each of the one or more spinners operative to independently spin or rotate about a horizontal axis;

a spinner housing comprising a cavity with a forward-facing opening into which the one or more spinners are inserted;

a plurality of caption strips removably inserted into a channel located on each of the plurality of sides or facets located on each of the one or more spinners;

one or more spinner covers containing the one or more spinners;

wherein the interactive module is inserted over at least one of the one or more tiered rows on the display assembly.

2. The interactive display fixture of claim 1, wherein the display assembly is a greeting card display assembly.

3. The interactive display fixture of claim 1, wherein the interactive display module contains three spinners arranged in a horizontal arrangement.

4. The interactive display fixture of claim 1 further comprising a sound module operative to store and play one or more sound files through a speaker upon movement of the one or more spinners.

5. The interactive display fixture of claim 1, wherein the one or more caption strips each contain a word or phrase printed thereon.

6. The interactive display fixture of claim 1 further comprising a sign panel placed over a front surface of the spinner housing.

7. An interactive display module comprising:

a spinner housing, containing two or more spinners, each of the two or more spinners having a plurality of sides or facets, and each of the two or more spinners operative to spin or rotate about a horizontal axis;

a plurality of caption strips removably inserted into a channel located on each of the plurality of sides or facets located on each of the one or more spinners;

a sign panel having a question printed thereon and a word or phrase printed thereon between each of the two or more spinners;

wherein the phrases printed between each of the two or more spinners and words or phrases printed on a front-facing caption strip on each of the two or more spinners combine to answer the question printed on the sign panel.

8. The interactive display module of claim 7, wherein each of the plurality of caption strips contain a word or phrase printed thereon.

9. The interactive display module of claim 8 further comprising a sign panel attached to a front surface of the spinner housing.

10. The interactive display module of claim 9, wherein the sign panel contains words or phrases thereon, which when combined with the words or phrases printed on each of the plurality of caption strips form a humorous phrase or sentence.

11. The interactive display module of claim 7 further comprising a sound module operative to store and playback at least one audio file upon movement of one of the two or more spinners.

12. The interactive display module of claim 7, further comprising a transparent spinner cover over each of the two or more spinners.

13. An interactive display module comprising:

a spinner module comprising:

a spinner housing having a top side, a bottom side opposite the top side, a right side, a left side opposite the right side, a back side connecting the top and bottom sides and the right and left sides, and an open front side opposite the back side;

one or more spinners, each of the one or more spinners having a plurality of sides or facets, the one or more spinners inserted into the spinner housing; and an attachment mechanism;

a sign panel attached to a front surface of the spinner housing, the sign panel having openings thereon through which the one or more spinners are inserted;

a plurality of caption strips having one or more words, phrases and/or images printed thereon, one of the plurality of caption strips placed into a channel on each of the plurality of sides or facets on the one or more spinners;

wherein each of the one or more spinners is operative to be turned or spun about a horizontal axis; and wherein the attachment mechanism on the spinner module is used to removably attach the interactive display module to a larger greeting card display fixture.

14. The interactive display module of claim 13, wherein the one or more words, phrases and/or images printed on a front-facing caption strip on each of the one or more spinners are combined to form a humorous phrase, sentence or image.

15. The interactive display module of claim 14, wherein the sign panel contains one or more words, phrases and/or images printed thereon.

16. The interactive display module of claim 15, wherein the one or more words, phrases and/or images printed on the sign panel combine with the one or more words, phrases and/or images printed on a front-facing caption strip on each of the one or more spinners to form a humorous phrase, sentence or image.

17. The interactive display module of claim 13 further comprising a sound module operative to store and playback an audio file through a speaker upon movement of the one or more spinners.

18. The interactive display module of claim 13, wherein the caption strips are interchangeable.

* * * * *